US007114563B2

(12) United States Patent
Rose

(10) Patent No.: US 7,114,563 B2
(45) Date of Patent: Oct. 3, 2006

(54) TUBING OR DRILL PIPE CONVEYED DOWNHOLE TOOL SYSTEM WITH RELEASABLE WIRELINE CABLE HEAD

(76) Inventor: Lawrence C. Rose, 1931 Brazos Crossing, Richmond, TX (US) 77406

( * ) Notice: Subject to any disclaimer, the term of this patent is extended or adjusted under 35 U.S.C. 154(b) by 156 days.

(21) Appl. No.: 10/825,905

(22) Filed: Apr. 16, 2004

(65) Prior Publication Data

US 2005/0230115 A1 Oct. 20, 2005

(51) Int. Cl.
*E21B 29/04* (2006.01)

(52) U.S. Cl. ..... 166/254.2; 166/54.6; 166/54.5

(58) Field of Classification Search ..... 166/54.5, 166/54.6, 301, 98, 254.2
See application file for complete search history.

(56) References Cited

U.S. PATENT DOCUMENTS 1,381,019 A * 6/1921 Samuelson ..... 166/54.6
3,401,749 A 9/1968 Daniel
3,942,373 A 3/1976 Rogers
4,082,144 A 4/1978 Marquis
4,237,972 A * 12/1980 Lanmon, II ..... 166/54.5
4,282,523 A 8/1981 Youmans
4,349,072 A 9/1982 Escaron et al.
4,388,969 A 6/1983 Marshall et al.
4,457,370 A 7/1984 Wittrisch
4,570,709 A 2/1986 Wittrisch
4,597,440 A 7/1986 Pottier
RE32,336 E 1/1987 Escaron et al.
4,690,214 A 9/1987 Wittrisch
4,700,778 A 10/1987 Smith et al.
4,738,312 A * 4/1988 Wittrisch ..... 166/54.5
4,877,089 A 10/1989 Burns
5,141,051 A * 8/1992 Lenhart ..... 166/65.1
5,392,851 A 2/1995 Arend
5,435,395 A 7/1995 Connell
5,477,921 A 12/1995 Tollefsen
5,704,393 A 1/1998 Connell et al.
5,762,142 A 6/1998 Connell et al.
5,845,711 A 12/1998 Connell et al.
5,984,009 A 11/1999 DiFoggio
6,032,733 A 3/2000 Ludwig et al.
6,450,022 B1 9/2002 Brewer

* cited by examiner

*Primary Examiner*—David Bagnell
*Assistant Examiner*—T Shane Bomar
(74) *Attorney, Agent, or Firm*—Conley Rose PC

(57) ABSTRACT

A downhole tool system comprising a side entry sub comprising a side entry adapted to receive a wireline, a cutting sub comprising a cutting apparatus, a cable head adapted to connect a downhole tool to the cutting sub, and a release releasably connecting the wireline to the cable head, the cutting apparatus adapted to cut the wireline. The downhole tool system is conveyed downhole on a pipe string to perform downhole operations. If lodged, the wireline may be released and removed from the downhole tool system such that fishing operations may be performed to retrieve the remaining portions of the downhole tool system. If lodged, the pipe string may also be released or removed from the downhole tool system such that fishing operations may be performed to retrieve the remaining portions of the downhole tool system.

17 Claims, 3 Drawing Sheets

TUBING OR DRILL PIPE CONVEYED DOWNHOLE TOOL SYSTEM WITH RELEASABLE WIRELINE CABLE HEAD

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

Operations are carried out in oil and gas wells for conveying tools downhole in the well. A wide variety of downhole tools may be supported on a wireline including tools to perform logging, setting, and retrieving operations. The tools typically comprise a combination of different tubular members threaded together to form a working unit that is manipulated from the surface via the wireline. The tools are lowered into and pulled out of the well selectively to perform the desired operation.

With a wireline tool, it is not unusual for the tools to become stuck as they are being retrieved from the well. However, the amount of tension that can be applied to the wireline in freeing the tools is limited by the strength of the wireline itself. Too much tension placed on the wireline causes it to break, typically at the surface. Consequently, tension put on the wireline is typically limited to 50% of the breaking strength of the wireline when new. The wireline and tools must then be recovered from the borehole. Major problems occur if the tools get stuck in the well and the wireline breaks upon pulling on the wireline with too much tension. Breaking the wireline and dropping the wireline in the well greatly complicates the fishing operation to retrieve the tools.

To prevent breaking the wireline when the tools become stuck, wireline tools typically include a cable head that connects the end of the wireline to the top of the tools. A release is also typically provided at the cable head to permit the wireline to be disconnected from the tools such as when the tools become stuck downhole. A wireline release may use a mechanical weak point in the connection between the wireline and the cable head, such as a metal member designed to break upon a predetermined pull on the wireline. The correct conventional mechanical weak point must be calculated and installed prior to running the cable head and tools into the borehole on the wireline. When the tools do become stuck, enough pull is placed on the cable head to release the weak point. A fishing tool is then run downhole on a pipe string, such as drill pipe or tubing, and connects to a fishing neck on the cable head. The fishing tool and pipe string allow a greater amount of pull to be exerted on the tools for extraction from the wellbore. The tools may also comprise a fishing neck for connection by a fishing tool. Various other apparatus and methods are also available for releasing the wireline from the cable head and tools.

Wireline tools can be run downhole using gravity as long as the inclination of the borehole with respect to the vertical does not become so great as to make displacement of the tools using gravity inoperable. For these highly inclined wells, the tools may be conveyed into the borehole using a pipe string with the tool attached to the downhole end of the pipe string. The tools communicate with the surface and are powered by a wireline that enters the inside of the pipe string through a pack-off in a side-entry-sub. When the tool approaches the zone of interest, the side-entry-sub is connected to the pipe string. The tool comprises a male connector portion at the top of the tool and inside the pipe string. A corresponding female connector portion at the end of the wireline is then conveyed down through the tubing and connected to the male connector portion of the tools to form what is called a "wet connect". The connection is called a wet connect because typically, the female connector portion is pumped down the inside of the pipe string using a fluid such that the connectors are immersed in the pumping fluid when the connection is made. The wireline exits the pipe string through the side-entry-sub and connects with the power and operating systems for the tool on the surface. The exposed portion of the wireline outside the pipe string is located in the annulus between the pipe string and the casing.

With the wet connection made, the side-entry-sub is run further downhole and more pipe sections are added to the pipe string until the tools reach the zone of interest. The side-entry-sub is typically only lowered to the lowermost section of casing so the exposed wireline does not travel into the open borehole. There may also be special cases where the side entry sub exits the casing and enters into the open borehole. In the example of a logging tool, the pipe string and tool are then raised with the logging tool receiving logging information on the formation until the side-entry-sub reaches the surface and must be removed from the pipe string. In some cases, the side-entry-sub must be removed while there is still formation to be logged. As such, the wet-connect must be broken, the side-entry-sub must be removed from the top of the pipe string, the pipe repositioned, the side-entry-sub must then be reinstalled, and the wet connection must be formed again by pumping the wireline to the tool at the end of the pipe string. This process is repeated until the entire formation zone of interest is logged.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
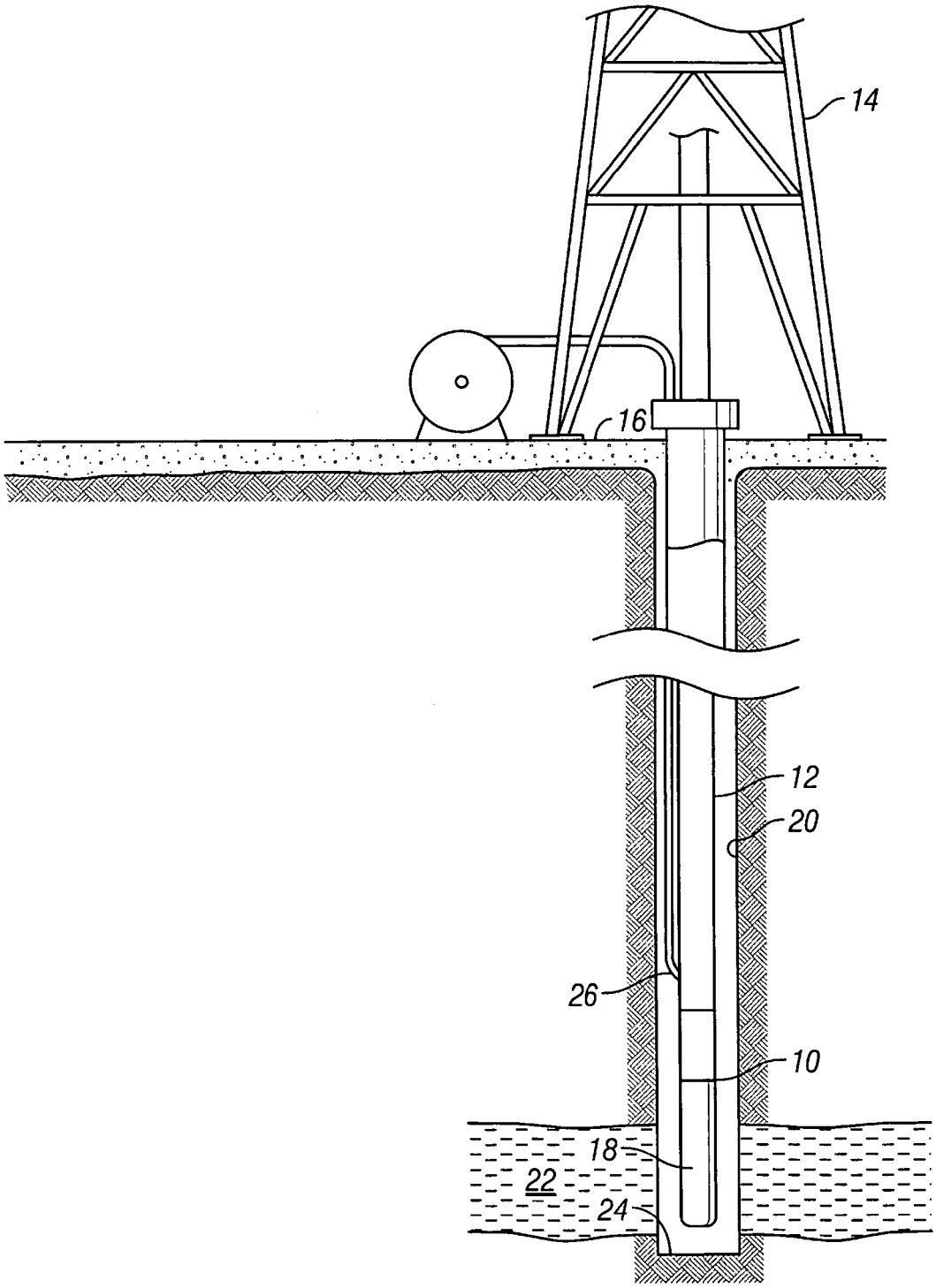
FIG. 1 is a schematic showing an embodiment of the downhole tool disposed within the borehole of a well.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

FIG. 1 shows a schematic view of a downhole tool system 10 supported by a pipe string 12 from a rig 14 at the surface 16. The pipe string may comprise tubing, drill string, or any other suitable pipe string. The downhole tool system 10 is disposed adjacent a production zone 22 located, as for example, near the bottom 24 of borehole 20. The downhole tool system 10 comprises a wireline 26 for powering the downhole tool system 10 and also for providing communication between the downhole tool system 10 and monitors (not shown) at the surface 16.

Figure 2:
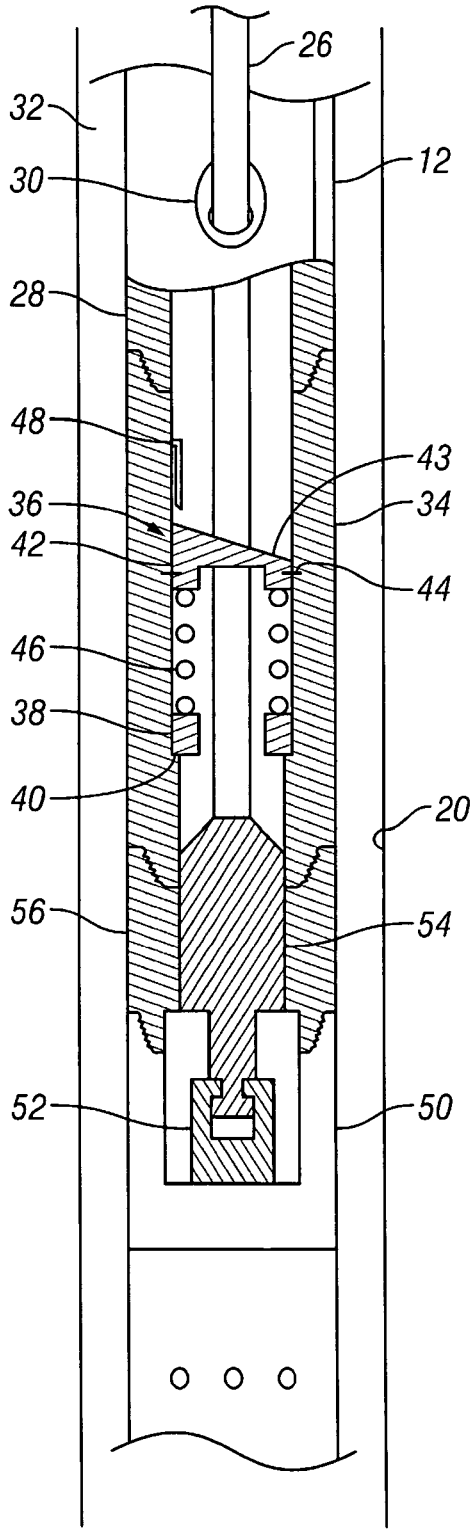
FIG. 2 is a partial cross-section showing the embodiment of the downhole tool with the wireline and cable head attached.

As shown in FIG. 2, the downhole tool system 10 comprises a side entry sub 28. The side entry sub 28 comprises a side entry 30 for receiving the wireline 26 from the annulus 32 between the side entry sub 28 and the borehole 20. The side entry 30 may be a pack-off sealing the inside of the side entry sub 28 from the annulus or any other suitable side entry for receiving the wireline 26. An example of a side entry is described in U.S. Pat. No. 4,388,969, hereby incorporated herein by reference for all purposes.

The downhole tool system 10 also comprises a cutting sub 34 comprising a cutting apparatus 36. The cutting sub 34 does not necessarily directly connect to the side entry sub 28, but may be indirectly connected through additional tubing sections. The cutting apparatus 36 receives the wireline 26 and comprises a trip bushing 38 engaged against a shoulder 40 inside the cutting sub 34. The cutting apparatus 36 also comprises a ram head 42 held in place by shear pins 44. Compressed between the ram head 42 and the trip bushing 38 is a spring 46 forcing the trip bushing 38 against the shoulder 40. The cutting apparatus 36 also comprises a cutting device 48 pivotally mounted inside the cutting sub 34. Similar cutting apparatuses are described in U.S. Pat. Nos. 4,738,312 and 5,477,921, hereby incorporated herein by reference for all purposes. The cutting apparatus 36 may also be any other type of cutting apparatus suitable for the downhole tool system 10.

The downhole tool system 10 also comprises a cable head 50 adapted to releasably connect a downhole tool 18 to the cutting sub 34. The cable head 50 does not necessarily directly connect to the cutting sub 34, but may be indirectly connected through additional tubing sections. The cable head 50 comprises a release 52 releasably connecting the cable head 50 to the wireline 26. The release 52 connects to a re-head 54 attached to the downhole end of the wireline 26. The cable head 50 also houses any power and communication connections (not shown) from the wireline to the downhole tool 18. The release 52 may comprise a fusible material that melts to allow a connector (not shown) to move to an unlatched position as described in U.S. Pat. No. 6,032,733, hereby incorporated herein by reference for all purposes. The release 52 may also comprise a mechanical release or an electrical release. The downhole tool system 10 also comprises a modified fishing neck 56 engaged with the cable head 50. The downhole tool system 10 also comprises a downhole tool 18 that may be any type of downhole tool. For example, the downhole tool 18 may comprise a formation logging tool. The downhole tool 18 may also comprise a casing or cement evaluation tool, a mechanical setting or release tool, an explosive tool for perforating or other purposes, or a production evaluation tool.

As shown in FIGS. 1 and 2, the downhole tool system 10 is conveyed downhole on a pipe string 12. The individual sections of the downhole tool system 10 need not be directly connected, but may be separated by sections of pipe making up the pipe string 12. Although FIGS. 1 and 2 show the downhole tool system 10 being conveyed into a vertical borehole 20, the downhole tool system may also be conveyed into a deviated borehole where at least a portion of the borehole deviates from the vertical direction. The downhole tool system 10 may be run downhole using any suitable method. For example, one may flow fluids through the inside of the pipe string 12 as the pipe string 12 is run in the borehole 20. The fluids would flow through the pipe string 12 and exit the pipe string 12 out into the annulus 32 between the pipe string 12 and the borehole 20 to return to the surface 16.

The downhole tool system 10 is assembled with the side entry sub 28 as the entrance point for the wireline 26 to the inside of the pipe string 12. Thus, as the downhole tool system 10 is conveyed downhole, at least a portion of the wireline 26 travels in the annulus 32 between the pipe string 12 and the borehole 20. The downhole tool system 10 is conveyed to the desired location, such as the production zone 22 located, as for example, near the bottom 24 of borehole 20. Once at the desired location, the downhole operations are performed using the downhole tool 18. For example, if the downhole tool 18 is a formation logging tool, the position of the formation logging tool may be manipulated by moving the pipe string 12. The formation logging tool may be pulled back toward the surface 16, logging the formation 22 as the formation logging tool passes through. Power to the formation logging tool is provided by the wireline 26. The wireline 26 also provides a communication conduit for information to be sent back to the surface 16.

During the positioning of the downhole tool system 10, the downhole tool system may become lodged in the borehole 20 due to the size or curvature of the borehole 20. If forces applied by the pipe string 12 are unable to dislodge the downhole tool system 10, the downhole tool system 10 may need to be released from the pipe string 12.

Figure 3:
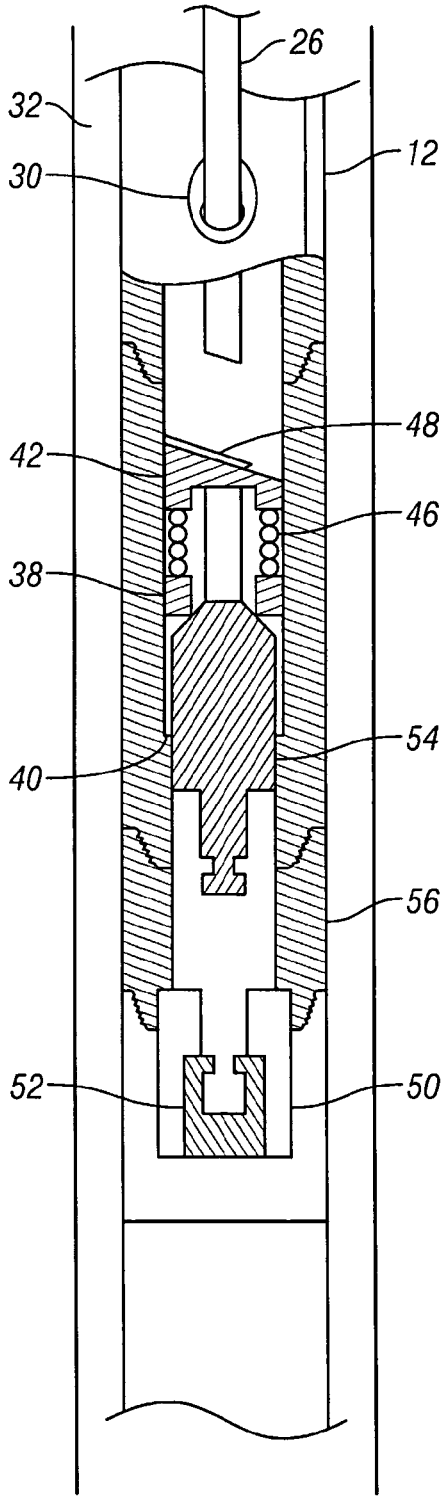
FIG. 3 is a partial cross-section showing the embodiment of the downhole tool with the wireline and cable head detached.

Releasing the downhole tool system 10 comprises releasing the wireline 26 from the cable head 50 by activating the release 52. In the case of a fusible release as described above, a signal is sent to the release 52 to melt the fusible material and release the re-head 54. A force may then be applied to the wireline 26 to move the re-head toward the cutting sub 34. The re-head 54 is adapted to engage the trip bushing 38 and apply the force on the wireline 26 to the trip bushing 38. Applying force to the trip bushing 38 causes the trip bushing 38 to move and compress the spring 46 against the ram head 42, held in place by the shear pins 44. Applying a sufficient amount of force to the trip bushing 38 causes the ram head 42 to shear the shear pins 44, releasing the ram head 42. Once released, the ram head moves under the force of the trip bushing 38 and the spring 46 toward the cutting device 48. The ram head comprises a forcing surface 43 that engages the cutting device 48, forcing the cutting device 48 into engagement with the wireline 26 such as to cut the wireline 26, as best shown in FIG. 3. The cutting apparatus 36 may also be any other suitable apparatus for cutting the wireline 26. Once the wireline 26 is cut and the re-head 54 removed, the wireline 26 may be retrieved from the downhole tool system 10 by removing the wireline 26 through the side entry 30 and bringing the wireline 26 to the surface 16.

With the wireline 26 removed, fishing operations may then be performed to dislodge the remaining portions of the downhole tool system 10, using any suitable method. For example, a safety sub installed with the downhole tool system 10 can be released to disengage the downhole tools 10 from the pipe string 12. Alternatively, a portion of the pipe string 12 may be removed from the downhole tool system 10 above where the downhole tool system 10 is lodged in the borehole 20. This may be as simple as un-making a connection in the pipe string 12. Operations may then be performed to dislodge the downhole tool system 10. For example, a stronger pipe string may then be conveyed downhole and attached to the remaining portion of the pipe string 12 or the downhole tool system 10, depending on where connection was un-made. For example, the stronger pipe string could attach to the modified fishing neck 56. The stronger pipe string may then be used to dislodge the downhole tool system 10 by being able to apply a greater force. A "jar" may also be conveyed downhole and connected to the downhole tool system 10. The "jar" imparts sudden impacts on the downhole tool system 10 to dislodge the downhole tool system 10 from the borehole 20. Any other suitable method may also be used to dislodge the downhole tool system 10 from the borehole 20. Once dislodged, the downhole tool system 10 may then be brought to the surface 16. The wireline 26 may then be re-attached and further downhole operations may be performed using the downhole tool system 10.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A downhole tool system comprising:

a side entry sub comprising a side entry adapted to receive a wireline;

a cutting sub comprising:

a trip bushing engageable by a re-head connected to the wireline;

the trip bushing being movable by the re-head to compress a spring against a ram head secured by shear pins; and a pivotally mounted cutting device adapted to be pivoted by the ram head when released by the shear pins and cut the wireline;

a cable head connecting a downhole tool to the cutting sub; and a release connecting the wireline to the cable head.

2. The downhole tool system of claim 1 where the downhole tool comprises a formation logging tool.

3. The downhole tool system of claim 1 where the side entry comprises a pack-off, the wireline entering the side entry sub through the pack-off.

4. The downhole tool system of claim 1 further comprising a modified fishing neck engaged with the cable head.

5. The downhole tool system of claim 1 where the release comprises a fusible material adapted to release the re-head engaged with the wireline.

6. The downhole tool system of claim 1 wherein the release is a mechanical release or an electrical release.

7. The downhole tool system of claim 1 wherein the downhole tool is a formation logging tool, a casing evaluation tool, a cement evaluation tool, a mechanical setting tool, a release tool, an explosive tool, or a production evaluation tool.

8. A method of performing downhole operations comprising:

conveying a downhole tool system downhole on a pipe string, the downhole tool system comprising a side entry sub, a cable head connecting a downhole tool to a cutting sub, and a release releasably connecting a wireline to the cable head;

activating the release to release the wireline from the cable head;

applying a force to the wireline to move a trip bushing in the cutting sub with a re-head engaged with the wireline;

compressing a spring against a ram head secured by shear pins with movement of the trip bushing;

shearing the shear pins to release the ram head;

pivoting a cutting device with the ram head to cut the wireline; and performing downhole operations with the downhole tool.

9. The method of claim 8 further comprising:

retrieving the wireline from the downhole tool system.

10. The method of claim 8 where performing downhole operations with the downhole tool comprises performing logging operations with a downhole logging tool.

11. The method of claim 8 wherein performing downhole operations with the downhole tool comprises evaluating casing, evaluating cement, operating a mechanical setting tool, operating a release tool, operating an explosive tool, or evaluating production.

12. A downhole tool system comprising:

a side entry sub comprising a pack-off adapted to receive a wireline;

a cutting sub comprising:

a trip bushing engageable by a re-head connected to the wireline;

the trip bushing being movable by the re-head to compress a spring against a ram head secured by shear pins; and a pivotally mounted cutting device adapted to be pivoted by the ram head when released by the shear pins and cut the wireline;

a cable head connecting a downhole formation logging tool to the cutting sub; and a release releasably connecting the wireline to the cable head.

13. The downhole tool system of claim 12 further comprising a modified fishing neck engaged with the cable head.

14. The downhole tool system of claim 12 where the release comprises a fusible material adapted to release the re-head engaged with the wireline to release the wireline from the cable head.

15. The downhole tool system of claim 12 wherein the release comprises a mechanical release or an electrical release.

16. A method of logging a downhole formation comprising:

conveying a logging tool system downhole on a pipe string, the logging tool system comprising a side entry sub, a cable head connecting a formation logging tool to a cutting sub, and a release releasably connecting a wireline to the cable head, the wireline exiting the side entry sub through a side entry;

activating the release to release the wireline from the cable head;

applying a force to the wireline to move a trip bushing in the cutting sub with a re-head engaged with the wireline;

compressing a string against a ram head secured by shear pins with movement of the trip bushing;

shearing the shear pins to release the ram head;

pivoting a cutting device with the ram head to cut the wireline; and performing logging operations with the formation logging tool.

17. The method of claim 16 further comprising:

retrieving the wireline from the logging tool system.

* * * * *